US007857732B2

(12) United States Patent
Nielson et al.

(10) Patent No.: US 7,857,732 B2
(45) Date of Patent: Dec. 28, 2010

(54) SWAY-CAPABLE STATIONARY BICYCLE

(76) Inventors: Gregg Stuart Nielson, P.O. Box 112112, Campbell, CA (US) 95011; Emil George Lambrache, 826 Sharon Ct., Campbell, CA (US) 95008

( * ) Notice: Subject to any disclaimer, the term of this patent is extended or adjusted under 35 U.S.C. 154(b) by 0 days.

(21) Appl. No.: 12/274,364

(22) Filed: Nov. 20, 2008

(65) Prior Publication Data

US 2010/0125029 A1 May 20, 2010

(51) Int. Cl.
*A63B 69/16* (2006.01)

(52) U.S. Cl. ..... 482/61; 482/57

(58) Field of Classification Search ..... 482/57, 482/61, 142, 146; 446/396; 472/135; 434/55
See application file for complete search history.

(56) References Cited

U.S. PATENT DOCUMENTS

| | | | | | |
|---|---|---|---|---|---|
| 1,509,750 | A * | 9/1924 | Campbell | 482/26 |
| 4,605,220 | A * | 8/1986 | Troxel | 482/79 |
| 4,743,012 | A * | 5/1988 | Kim | 482/61 |
| 4,817,939 | A * | 4/1989 | Augspurger et al. | 482/61 |
| 4,969,642 | A * | 11/1990 | Phillips | 482/61 |
| 5,035,418 | A * | 7/1991 | Harabayashi | 482/62 |
| 5,042,795 | A * | 8/1991 | Bursik | 482/61 |
| 5,046,723 | A * | 9/1991 | Szymski et al. | 482/57 |
| 5,112,045 | A * | 5/1992 | Mason et al. | 482/9 |
| 5,382,208 | A * | 1/1995 | Hu | 482/63 |
| 5,533,899 | A * | 7/1996 | Young | 434/61 |
| 6,027,342 | A * | 2/2000 | Brown | 434/55 |
| 6,102,832 | A * | 8/2000 | Tani | 482/4 |
| 6,126,577 | A * | 10/2000 | Chang | 482/57 |
| 6,322,480 | B1 * | 11/2001 | Lim et al. | 482/57 |
| 6,445,960 | B1 * | 9/2002 | Borta | 700/28 |
| 6,634,885 | B2 * | 10/2003 | Hodgetts et al. | 434/55 |
| 6,676,579 | B1 * | 1/2004 | Lin | 482/146 |
| 6,733,293 | B2 * | 5/2004 | Baker et al. | 434/55 |
| 6,761,666 | B2 * | 7/2004 | Chou | 482/52 |
| 7,081,070 | B1 * | 7/2006 | Washington et al. | 482/57 |
| 7,147,593 | B2 * | 12/2006 | Vittone | 482/142 |
| 7,326,151 | B2 * | 2/2008 | Peterson et al. | 482/61 |
| 7,438,672 | B1 * | 10/2008 | Rylander et al. | 482/61 |
| 7,645,221 | B1 * | 1/2010 | Curry | 482/148 |
| 2004/0023766 | A1 * | 2/2004 | Slone | 482/146 |
| 2004/0053751 | A1 * | 3/2004 | Pizolato | 482/61 |
| 2007/0054782 | A1 * | 3/2007 | Lin | 482/57 |
| 2007/0105694 | A1 * | 5/2007 | Panatta | 482/57 |
| 2007/0184940 | A1 * | 8/2007 | Tomes | 482/92 |
| 2007/0184953 | A1 * | 8/2007 | Luberski et al. | 482/146 |
| 2007/0202998 | A1 * | 8/2007 | Wan | 482/61 |
| 2009/0186746 | A1 * | 7/2009 | Pandolfo | 482/7 |

* cited by examiner

*Primary Examiner*—Rinaldi I Rada
*Assistant Examiner*—Andrew M Tecco
(74) *Attorney, Agent, or Firm*—Donald R. Boys; Central Coast Patent Agency, Inc.

(57) ABSTRACT

A sway capable bicycle has a bicycle frame firmly mounted on a sway-capable upper base mounted on a lower base and which has resilient members connecting each corner of the base support to the corresponding corner of the upper base.

7 Claims, 9 Drawing Sheets

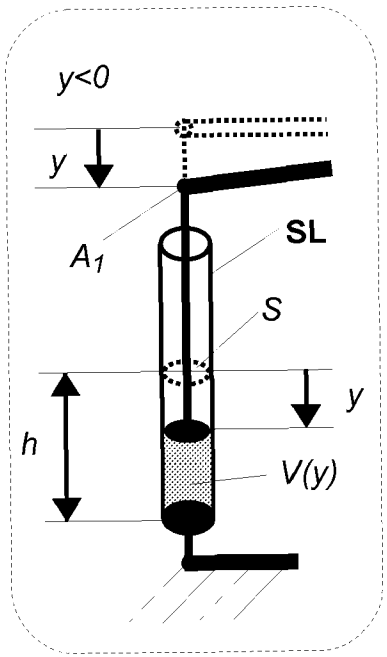
Fig. 6
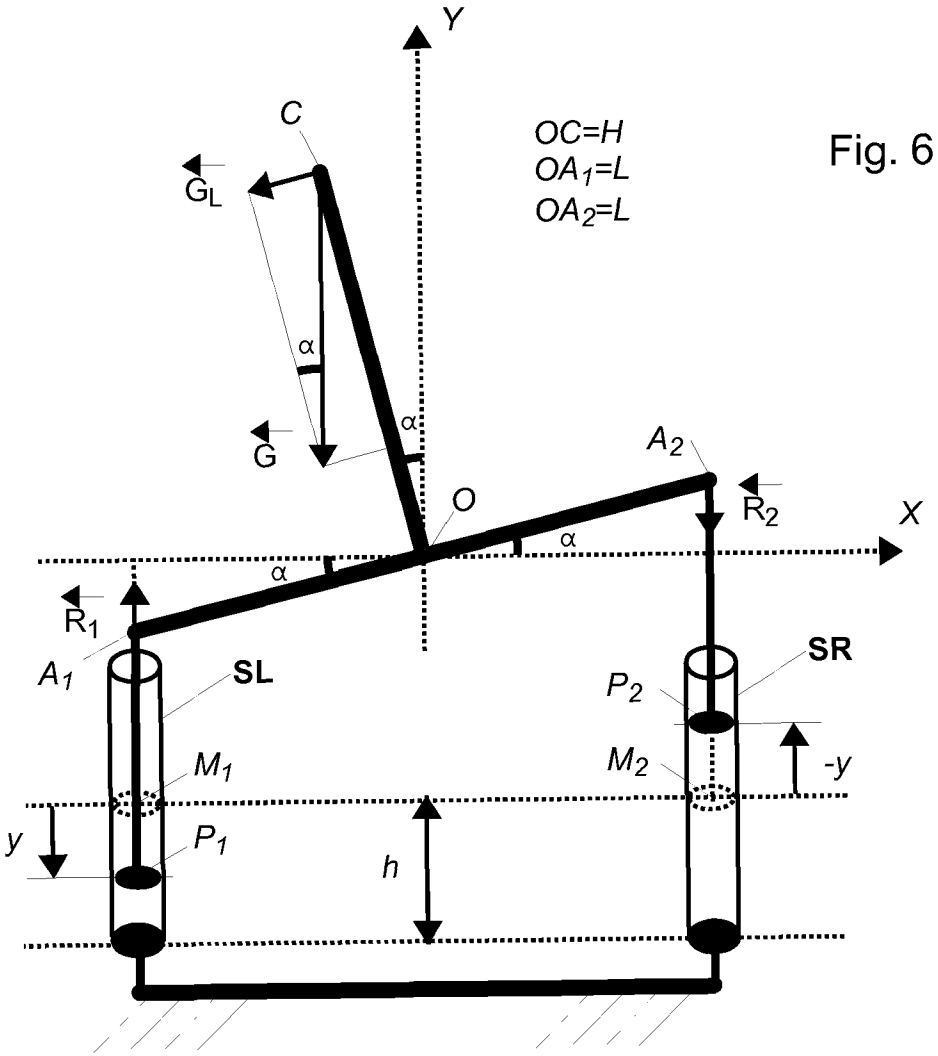

$\alpha_{max}$=0.14 rad (8 deg)
G =800N (80kg)
H =0.8m (80cm)
h =0.01m (1cm)

SWAY-CAPABLE STATIONARY BICYCLE

FIELD OF THE INVENTION

The present invention relates generally to stationary cycling equipment and specifically to improving it in order to bring closer the in-place riding movement to the real bicycle riding on the road.

BACKGROUND ART

With reference to FIG. 1, a conventional heavy duty stationary bicycle 100 comprises usually an H-shaped frame 101, comprising bars 101A, 101B and 101C, with a saddle 102 at its top back corner, a pair of handlebars 103 placed at the top front corner and the two pedals crank mechanism 104 placed at the middle height of the frame under the feet of the rider. The pedal crank mechanism usually drives an inertial wheel 105 (also called flywheel) through a transmission belt or chain 106. The inertial wheel reduces the pedaling speed fluctuations and also through the transmission chain presents the rider with the controllable movement resistance provided by the braking system 107 attached to the wheel. The braking system can be of frictional nature or electromagnetic nature or both. The frame 101 is mounted on a supporting base 108 (made of horizontal bars and/or planks) of a large enough rectangle footprint to make the entire equipment unconditionally (i.e. absolutely) fixed in all three planes of motion. This totally fixed nature of the state-of-the-art stationary cycling equipment reduces to zero all the real balance challenges any rider encounters on a real bicycle which moves in all three planes of motion.

With reference to FIG. 2, another state-of-the-art way of implementing a stationary bicycle is to mount a real (road or mountain) bicycle 200 on a trainer 201. The trainer comprises a support 202, an electromagnetic or friction braking roller 203 upon which the rear wheel of the bicycle 200 rests with strong friction and a fork 204, which holds the rear axle of the bicycle 200 in a fixed position but still allowing it to freely turn. The wheel groove support 205 for the front wheel of the bicycle 200 keeps the horizontal alignment. The rider exerts the effort to work against the braking action of the roller 203. The end result is the same as in the case of the stationary bicycle depicted in FIG. 1 because the road bicycle 200 becomes absolutely fixed in all three planes of motion. The trainer 201 provides absolute support in all planes of motion similar to the support base 108 and acts as the variable braking system similar to the braking system 107 from FIG. 1.

On a real bicycle, although being the smallest movement among the three planes of movement, the most difficult to control movement happens in the frontal plane of the rider (vertical side to side sway movement). This lateral movement or sway of the rider plus bicycle system is the movement which the rider has to learn to control and minimize at all times to avoid crashing to the ground.

Because the goal is to minimize the lateral sway, this movement in the frontal plane of the rider is better described as the main balance challenge for the bicycle rider. Yet, the state-of-the-art stationary bicycle does not exhibit this challenge at all, so it does not constitute a step in any continuous progression aimed at preparing and improving the real bicycle riding skills. It is only a means to train the cardiovascular system and the endurance of the rider by the means of the braking resistance applied to the inertial wheel which the rider has to overcome with the increased legs effort needed to keep the pedals moving. The upper body can be totally relaxed, which is not the case in real riding, where the upper body movement is an essential part in providing the balance of the rider and the bicycle.

SUMMARY OF THE INVENTION

A sway capable stationary bicycle base and its operation make the object of this patent disclosure. The sway capable stationary bicycle base, as its name suggests, makes any stationary bicycle mobile and moreover conditionally unstable in the frontal plane of the rider, i.e. the bicycle can lean from side to side, and thus confronts the rider with the main balance challenge any real bicycle exhibits too. This is achieved in the present embodiment of this invention by placing a stationary bicycle not on a solid supporting rectangular base, but on a sway capable base, which comprises a base core capable to sway side to side, relative to the upright equilibrium plane of the bicycle frame, by rotating on two hinges mounted on a base support which rests on the ground. The connecting medium between the base core and the base support can be implemented as 4 pneumatic or hydraulic struts placed in each corner of the base support to the corresponding corner of the base core above with ball-and-socket joints. The base connecting medium can also be implemented as a single or multiple elastic air-filled chamber(s) under variable pressure or with a waterbed viscous like structure.

The entire rider plus bicycle system exhibits an unstable equilibrium at the upright position which challenges the rider to sway his body from side to side to counterbalance the swaying of the bicycle itself in a similar manner to a real road bicycle. The struts or the elastic air-filled chambers have a stiffening response at large sway angles in order to limit the swaying to safe limits and avoid the crashing of the rider sideways under the lateral component of the rider own weight. The entire system potential energy dependence on the sway angle has the shape of a gravitational well with a raised bottom center.

The essential functionality of this invention consists in asking the rider to perform a contralateral movement with the upper body in relation to the lower body, mainly the legs, so that the rider's center of gravity, which lies in the pelvic region, remains at all times on top of the supporting footprint of the bicycle. Or, for more advanced riders, this invention allows the rider to perform an ipsolateral (same side) movement with the upper body in relation to the lower body, but only if, as in real road or mountain riding, the rider sways the bicycle a lot to the opposite side.

In comparison, the state-of-the-art totally fixed bicycle allows the rider to perform an ipsolateral (same side lateral) movement with the upper and lower body to increase the pressure on the pedal of that side to make the effort easier, without requiring the upper body of the rider to sway the bicycle considerably to the opposite side. Such an ipsolateral movement on a real bicycle would cause an immediate crash if the rider did not sway quite a lot the bicycle itself to the opposite side, while the rider remained essentially vertical. This happens totally unlike the stationary bicycle case, where the stationary bicycle stays vertical, but the rider sways the entire body to the same side.

Making the stationary bicycle conditionally unstable in the frontal plane of the rider brings the stationary exercise inside a continuous progression aimed at real bicycle riding skills improvement, not just endurance and cardiovascular training. Moreover, it does not teach the rider the wrong ipsolateral movement (where the bike stays vertical and the rider sways a lot the entire body to the same side), but recruits the correct contralateral movement (where the bike essentially sways very little while the rider sways the upper body contralateral to the lower body) or the right ipsolateral movement (where the bike sways a lot to one side while the body of the rider sways very little to the opposite side).

The effective gravitational pull on the rider is adjustable with this invention. This adjustment occurs by varying the elasticity of the base connecting medium in the manner that the less sway resistance the base exhibits, the bigger the effective gravitational pull on the rider becomes and the more difficult it is for the rider to maintain balance.

BRIEF DESCRIPTION OF THE DRAWINGS

FIG. 3 also includes a detail showing the hinge which is capable of gliding vertically.

FIG. 4 also includes a detail showing the cardanic cross hinge which is capable of gliding vertically but prevents any rotation in the transverse (horizontal) plane.

FIG. 6 is a simplified diagram of the forces and angles acting in the frontal plane of the system described in FIG. 3. FIG. 6 includes also a detail showing a simplified diagram of a pneumatic strut used in the FIG. 3 system.

FIG. 8 also includes a detail showing the simplified diagram of an elastic air-filled chamber.

DETAILED DESCRIPTION OF THE PREFERRED EMBODIMENT

Figure 3:
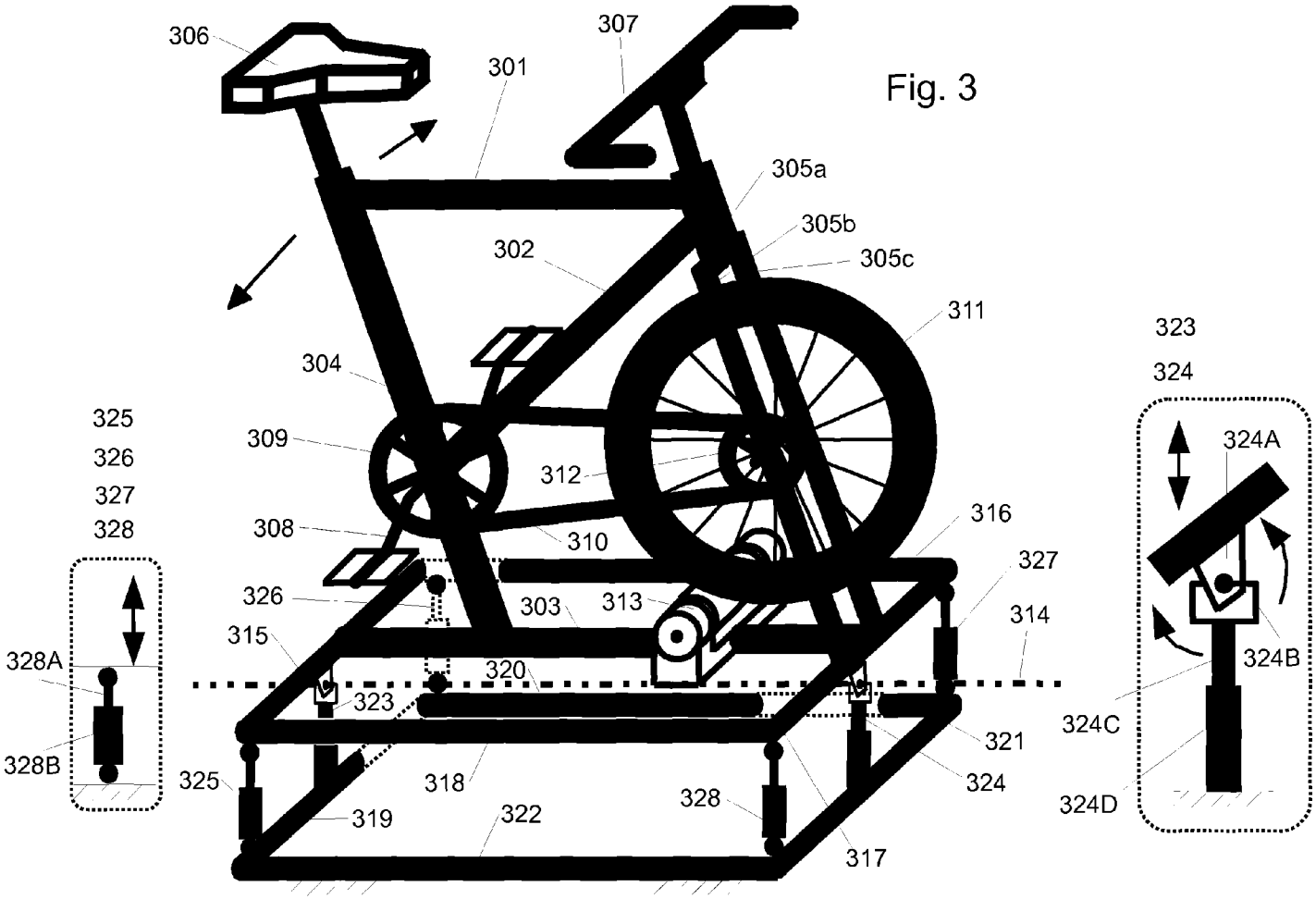
FIG. 3 is a diagram of a side to side sway capable base built with 4 pneumatic or hydraulic struts and this base has a conventional light weight stationary bicycle frame mounted on top of it.

With reference to FIG. 3, here is the description of a sway capable base using 4 hydraulic struts with a conventional light weight stationary bicycle frame mounted on top of it. The bicycle frame comprises two connecting horizontal bars 301 and 303, a diagonal bar 302 to insure frame rigidity, and two quasi-vertical tubes 304 and 305*a* (where 305*a* is prolonged by the 2 side bars 305*b* and 305*c*), the saddle 306 mounted on the seat tube 304 aligned back at about 20 degrees from the vertical direction, the handlebars subassembly 307 mounted on the front tube 305*a*, which is aligned parallel to the seat tube 304, the two pedals and crank arms shaft 308 with the driving sprocket 309, the chain 310, the inertial front wheel (flywheel) 311 with the gear 312 sustaining the other end of the chain 310 (where gear 312 is sustained by an axis mounted between tubes 305*b* and 305*c*), and the electromagnetic or frictional brake 313 mounted on bar 303.

Each of the quasi-vertical tubes of the frame, 304, 305*b* and 305*c*, is fixed above the middle of a horizontal lateral bar, the back one 315 and the front one 317. Together with the horizontal bars 316 and 318, the lateral horizontal bars 315 and 317 are building together the base core, which at equilibrium is situated in the transverse (horizontal) plane. The base core is part of the base which comprises also 4 pneumatic or hydraulic struts labeled 325, 326, 327 and 328. The struts are placed themselves on the four corners of the base support, which is similar to the base core and has identical dimensions, and comprises side bars 319, 320, 321 and 322. The struts are connected to both the base core and the base support through ball-and-socket type of joints. In the middle of each of the lateral bars 315 and 317 of the base core there are the hinges 323 in the back and 324 in the front, which are fixed on their other side respectively in the middle of the lateral bars 319 and 321 of the base support. The hinges 323 and 324 are sliding hinges which allow the base core to sway side to side in the frontal plane by rotating around the axis 314, which connects the centers of the hinges 323 and 324, but also allow the entire axis 314 to move up and down to find the balance between the weight of the rider plus bicycle and the resistance of the struts.

The detail on the left of FIG. 3 shows a simplified diagram of a pneumatic or hydraulic strut, where the piston rod 328A glides inside the cylinder 328B. The detail on the right of FIG. 3 shows a simplified diagram of the hinge 324, where the hinge head 324A rotates on the axis supported by the fork 324B. The fork 324B is fixed on the piston rod 324C which glides inside the cylinder 324D.

Figure 4:
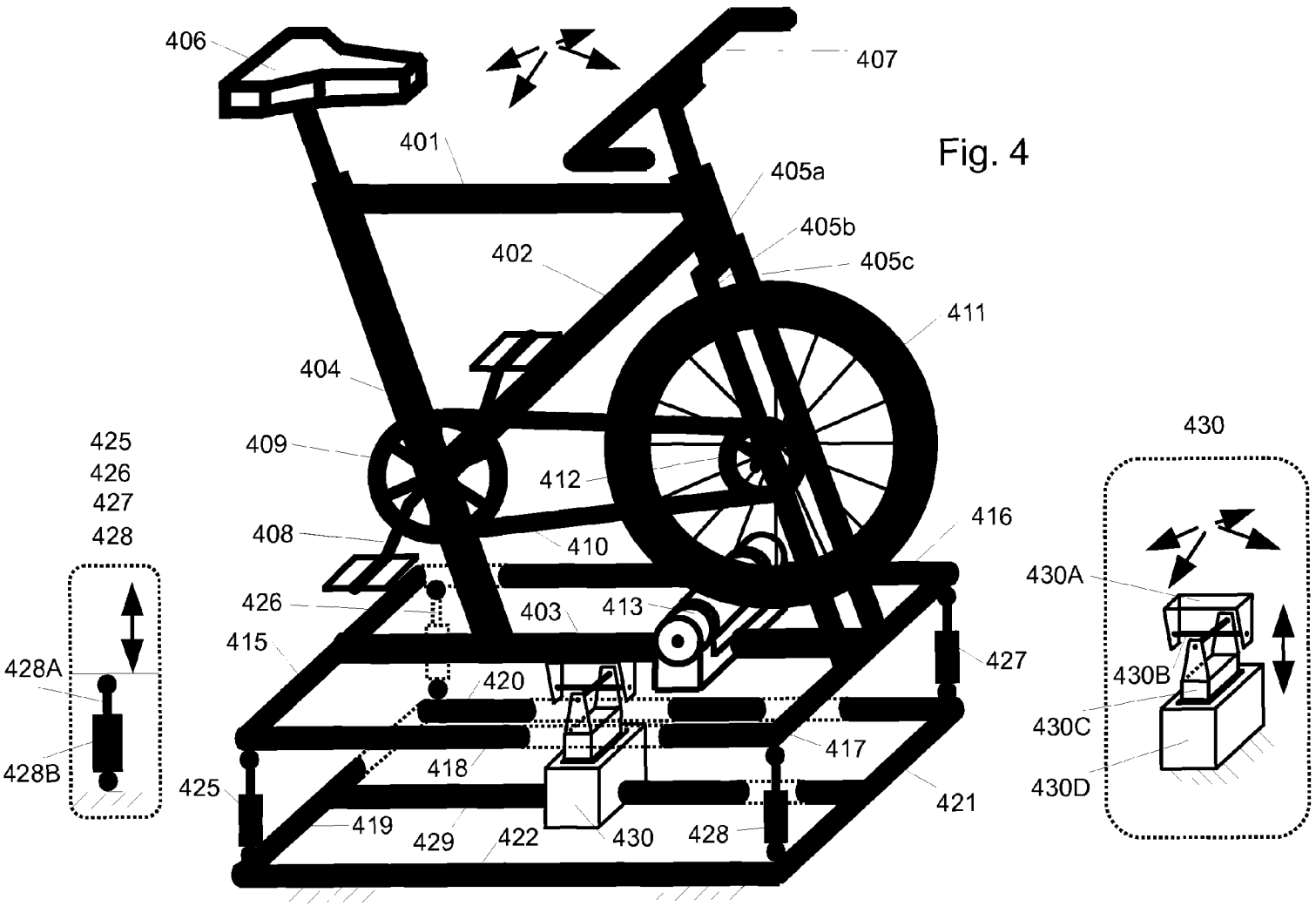
FIG. 4 is a diagram of a side to side and front to back sway capable base built with 4 pneumatic or hydraulic struts and this base has a conventional light weight stationary bicycle frame mounted on top of it.

With reference to FIG. 4, any item labeled 4*xx* corresponds to the item 3*xx* on FIG. 3 with the following exceptions. The hinges 323 and 324 are replaced by the cardanic cross hinge 430, which is detailed on the right of FIG. 4, and comprises the hinge head 430A which can sway in two planes on the cardanic cross supported by the fork 430B. The fork 430B is fixed on top of the piston bar 430C which glides inside the pump body 430D. The cardanic cross hinge must have the piston rod 430C and the pump body 430D with a rectangular cross-section in order to prevent any rotation in the horizontal plane. Any rotation in the horizontal plane of the bicycle frame in FIG. 4 would lead to an immediate crash of the entire system, because the struts 425 to 428 are mounted with ball-and-socket joints and cannot take any rotational effort. This is why the cross-sectional area of the hinge head 430A and the rest of the hinge 430 have to be big enough to be able to withstand the torque in the horizontal plane transmitted through the frame bar 403.

Figure 1:
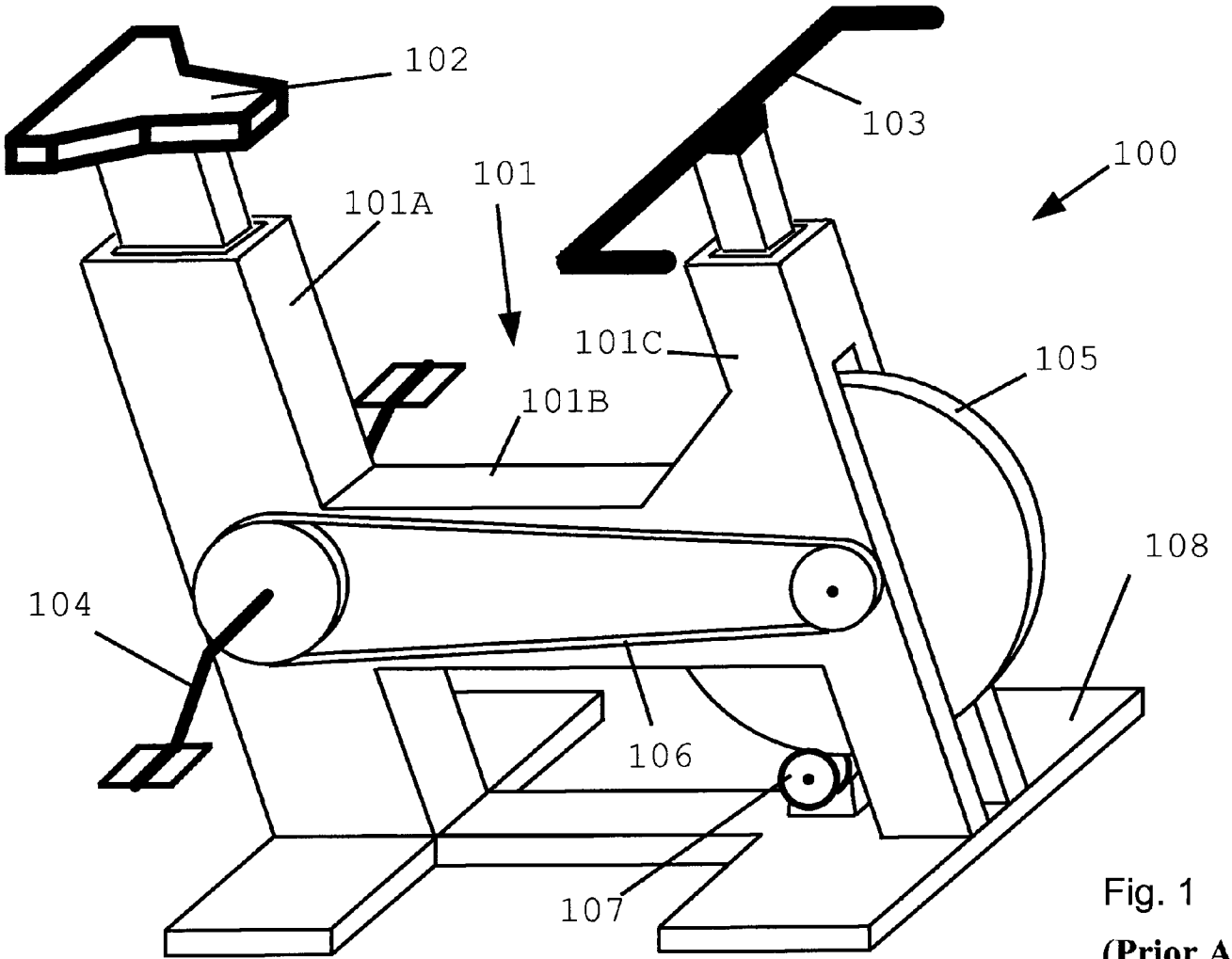
Fig. 1 (Prior Art)
FIG. 1 is a diagram of a prior art conventional heavy duty stationary bicycle.
Figure 5:
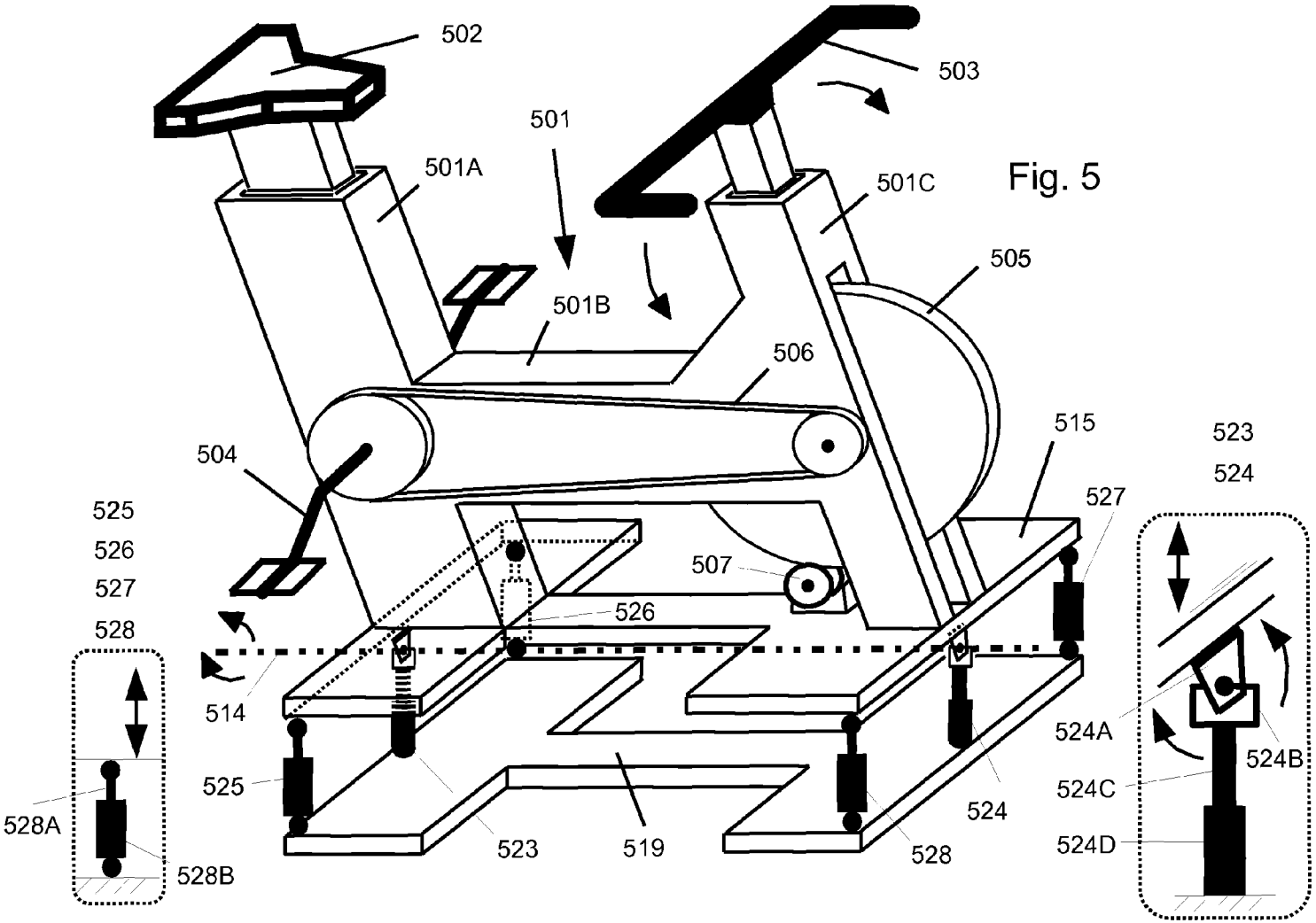
FIG. 5 is a diagram of a side to side sway capable base built with 4 pneumatic or hydraulic struts and this base has a conventional heavy duty stationary bicycle frame mounted on top of it.

With reference to FIG. 5, one can see that the heavy duty conventional stationary bicycle frame of FIG. 1 is mounted on the side to side sway capable base of FIG. 3. The main purpose of this FIG. 5 is to show that a heavy frame will not provide a close riding experience to a real road bike, mainly because of the greater inertia of the frame itself and also of the flywheel. The struts 525 to 528 have to be accordingly much stronger than the struts 325 to 328 of FIG. 3 where the sway capable base is supporting a light weight bicycle frame.

With reference to FIG. 6, the simplified dynamics of the lateral sway of the rider plus bicycle system can be expressed in terms of the mass center torque equation. The stability of the rider plus the bicycle system is ensured if the resulting torque in the frontal plane acts opposite of the angular displacement and thus brings back the rider to the vertical position.

The rider plus bicycle system has the mass center C at the distance H from the pivoting point O which lies on the middle axis 314 of the base core and at equal distance L from the side bars 316 and 318. Because the sway happens only in the frontal plane, the two struts on the left side of the rider can be lumped together into strut SL and the two struts on the right side of the rider can be lumped together into strut SR. The equivalent strut SL acts on the middle point of bar 316 labeled $A_1$ and equivalent strut SR acts on the middle point of bar 318 labeled $A_2$. Of course, the 4 corner struts 325 to 328 can be replaced also for real with just the two struts SL and SR in another version of the invention embodiment in FIG. 3, but with less reliability.

The gravity force G decomposes into a normal component (not shown and compensated by the hinges) and a lateral component $G_L$, depending upon the angle $\alpha$ between the segment OC and the vertical axis OY. The forces G and $G_L$ enclose the angle $\pi/2-\alpha$, so the following relationship holds:

$$G_L=G*\sin\alpha \quad \text{(Eq. 1)}$$

Because the angle between the segment $OA_1$ of length L and the horizontal axis OX is also $\alpha$, the displacement y of the strut SL equals:

$$y=L*\sin\alpha \quad \text{(Eq. 2)}$$

Let us consider the torques around the axis OZ (which is also axis 314 on FIG. 3). Because of the angular displacement $\alpha$, strut SL exhibits the force $R_1$ and strut SR exhibits the force $R_2$, which create torques opposing to the torque created by the lateral component $G_L$ of gravity. Because $G_L$ has segment OC of length H as its arm, $R_1$ has segment $OA_1$ of length L as its arm and $R_2$ has segment $OA_2$ of length L as its arm, the total torque acting on the rider plus bicycle system is:

$$M=G_L*H-(R_1*L+R_2*L) \quad \text{(Eq. 3)}$$

In order to express the forces $R_1$ and $R_2$ in terms of the angular displacement, with reference to the detail in FIG. 6, the simplified diagram of the strut SL considers it as an air-filled cylinder under pressure, having at rest the length h, pressure p0 and volume V0. Rest is defined the rider plus bicycle upright position where $\alpha=0$, so h is not the zero force resting length of the strut, but rather the resting length of the strut under the force G/2 (since there are two struts in the system). This is possible because the hinges 323 and 324 are sliding hinges which allow the axis OZ (314) to adjust up or down depending on G.

The strut cross-sectional area is S. The linear displacement of the strut is y and it is given by equation 2 mentioned above.

The volume V(y) of the strut is given by the following equation:

$$V(y)=S*(h-y) \quad \text{(Eq. 4)}$$

The pressure p(y) on the strut is related to the force F(y) acting on the strut:

$$p(y)=F(y)/S \quad \text{(Eq. 5)}$$

From the general gas law the following equation holds:

$$p(y)*V(y)=p0*V0 \quad \text{(Eq. 6)}$$

By replacing the terms in Equation 6 one obtains:

$$p(y)*V(y)=F(Y)/S*S*(h-y)=F(y)*(h-y)=p0*V0$$

Same holds for y=0 also, so one obtains:

$$F(0)*(h-0)=F0*h=p0*V0$$

As explained above F0 is the resting force on the strut:

$$F(0)=F0=G/2 \quad \text{(Eq. 7)}$$

Finally one obtains the expression for F(y):

$$F(y)*(h-y)=F0*h$$

$$F(y)=F0*h/(h-y) \quad \text{(Eq. 8)}$$

One obtains now the expression for $R_1(y)$:

$$R_1(y)=F(y)-F0=F0*h/(h-y)-F0=F0*y/(h-y)$$

$$R_1(y)=F0*y/(h-y) \quad \text{(Eq. 9)}$$

By anti-symmetry around the origin O one obtains:

$$R_2(y)=-R1(-y)=-F0*(-y)/(h+y)$$

$$R_2(y)=F0*y/(h+y) \quad \text{(Eq. 10)}$$

Going back to the torque equation 3 and replacing $G_L$, $R_1$ and $R_2$ in terms of the strut linear displacement y, the following calculations hold:

$$M=G_L*H-(R_1*L+R_2*L)$$

$$M=G*y/L*H-L*(F0*y/(h-y)+F0*y/(h+y))$$

Remembering that F0=G/2 one obtains further:

$$M = G*H/L*y - G/2*L*\frac{2*h*y}{h^2-y^2}$$

Because the system sway is limited to small angular displacements one can use the following approximation:

$$y=L*\sin\alpha\cong L*\alpha \quad \text{(Eq. 11)}$$

This greatly simplifies the torque expression:

$$M = G*H/L*L*\alpha - G*L*\frac{h*L*\alpha}{h^2-L^2*\alpha^2} \quad \text{(Eq. 12)}$$

One defines the maximum angular displacement as:

$$\alpha_{max}=h/L<<1 \quad \text{(Eq. 13)}$$

The definition is justified by the fact that the strut resistance goes to infinite when a approaches $\alpha_{max}$, so the rider and bicycle system are protected against crashing. Furthermore, the value is much smaller than 1, which justifies again the approximation made in equation 11.

Replacing equation 13 in 12 one obtains the final expression for the total torque:

$$M(\alpha)=G*H*\alpha-G*h*\alpha/(\alpha_{max}^2-\alpha^2) \quad \text{(Eq. 14)}$$

The torque depends only on the angular displacement $\alpha$ and not on the past trajectory, which means that our system is conservative (since we have neglected all friction in the frontal plane). This allows the computation of the potential energy:

$$M(\propto) = -\frac{dU(\propto)}{d\propto} \quad \text{(Eq. 15)}$$

Choosing U(0)=0 one obtains:

$$U(\propto) = -\int_0^{\propto} M(u)*du \quad \text{(Eq. 16)}$$

With the variable substitution:

$$\frac{u*du}{\propto_{max}^2 - \propto^2} = -\frac{1}{2}*\frac{d(\propto_{max}^2 - \propto^2)}{\propto_{max}^2 - \propto^2} = -\frac{1}{2}*d\ln(\propto_{max}^2 - \propto^2)$$

One obtains the final expression for the potential energy:

$$U(\propto) = -\frac{1}{2}*G*H*\propto^2 + \frac{1}{2}*G*h*\ln\left(\frac{\propto_{max}^2}{\propto_{max}^2 - \propto^2}\right) \quad \text{(Eq. 17)}$$

For α very close to zero, one can approximate:

$$\ln\left(\frac{\propto_{max}^2}{\propto_{max}^2 - \propto^2}\right) \cong \frac{\propto^2}{\propto_{max}^2} \quad \text{(Eq. 18)}$$

This allows one to obtain the potential energy simplified equation around the upright position (zero angular displacement):

$$U(\propto) = -\frac{1}{2}*G*H*\propto^2*\left(1 - \frac{L^2}{h*H}\right) \quad \text{(Eq. 19)}$$

In order to create the unstable equilibrium in the upright position the following equation must hold:

$$1 - \frac{L^2}{h*H} > 0 \text{ or: } L^2 < h*H \quad \text{(Eq. 20)}$$

Figure 7:
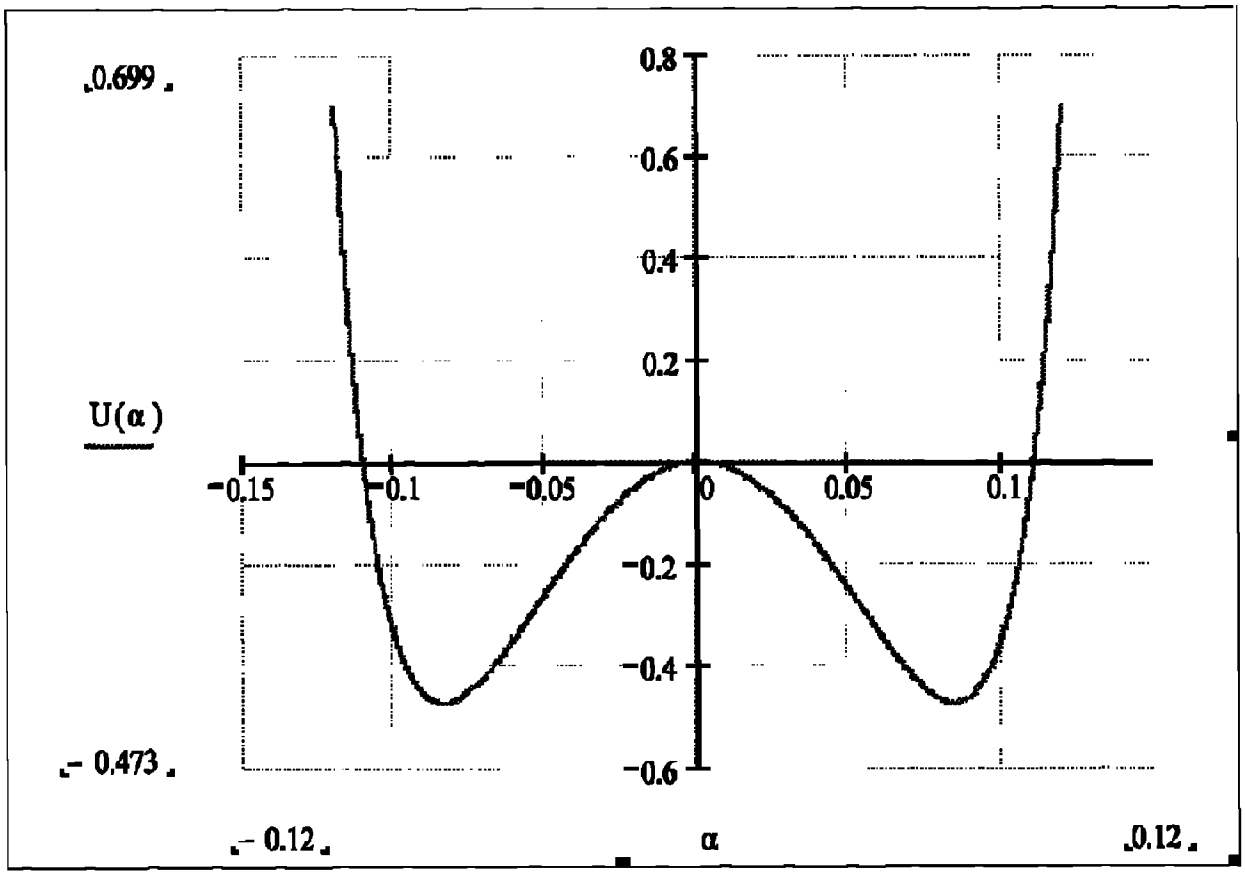
FIG. 7 depicts the potential energy dependence on the angular displacement $U(\propto)$ which has the shape of a gravitational well with a raised bottom center.

When equation 20 holds, the potential energy U(∝) exhibits the behavior of a gravitational well with a raised bottom center, which means that the rider has an unconditionally unstable upright position, like on a real bicycle, but has on both sides unconditionally stable end positions, which resemble essentially training wheels on both sides of the bicycle. The graph of the potential energy U(∝) is depicted in FIG. 7. Equation 20 predicts that if L is increased, then the upright equilibrium becomes unconditionally stable, which makes sense because the strut resistance gets a bigger contribution into the torque summation.

It is of great importance that the hinges 323 and 324 allow the base core (315, 316, 317 and 318) to slide vertically and as such allow the struts to find the equilibrium position where Equation 7 holds. Equation 7 states that the equilibrium position of the bicycle self-adjusts for the rider's weight. Moreover, the elasticity of the struts self-adjusts according to the rider's weight. If the hinges 323 and 324 had been simple hinges with a fixed axis, not vertically gliding, then the struts would have had to be adjusted according to the rider's weight: more pressure (i.e. higher resistance) for a heavier rider. With the gliding hinges, the struts self-adjust to a higher pressure setting for a heavier rider because they support the bigger weight even in the resting position. With non-gliding hinges, the struts combined force F0 must be made equal to G by external pressure adjustment, so that the strut resistance forces $R_1$ and $R_2$ will maintain their matching to $G_L$ (which is proportional to G). This would have been more complicated and cumbersome for the rider than using gliding hinges for the construction of this invention.

Figure 8:
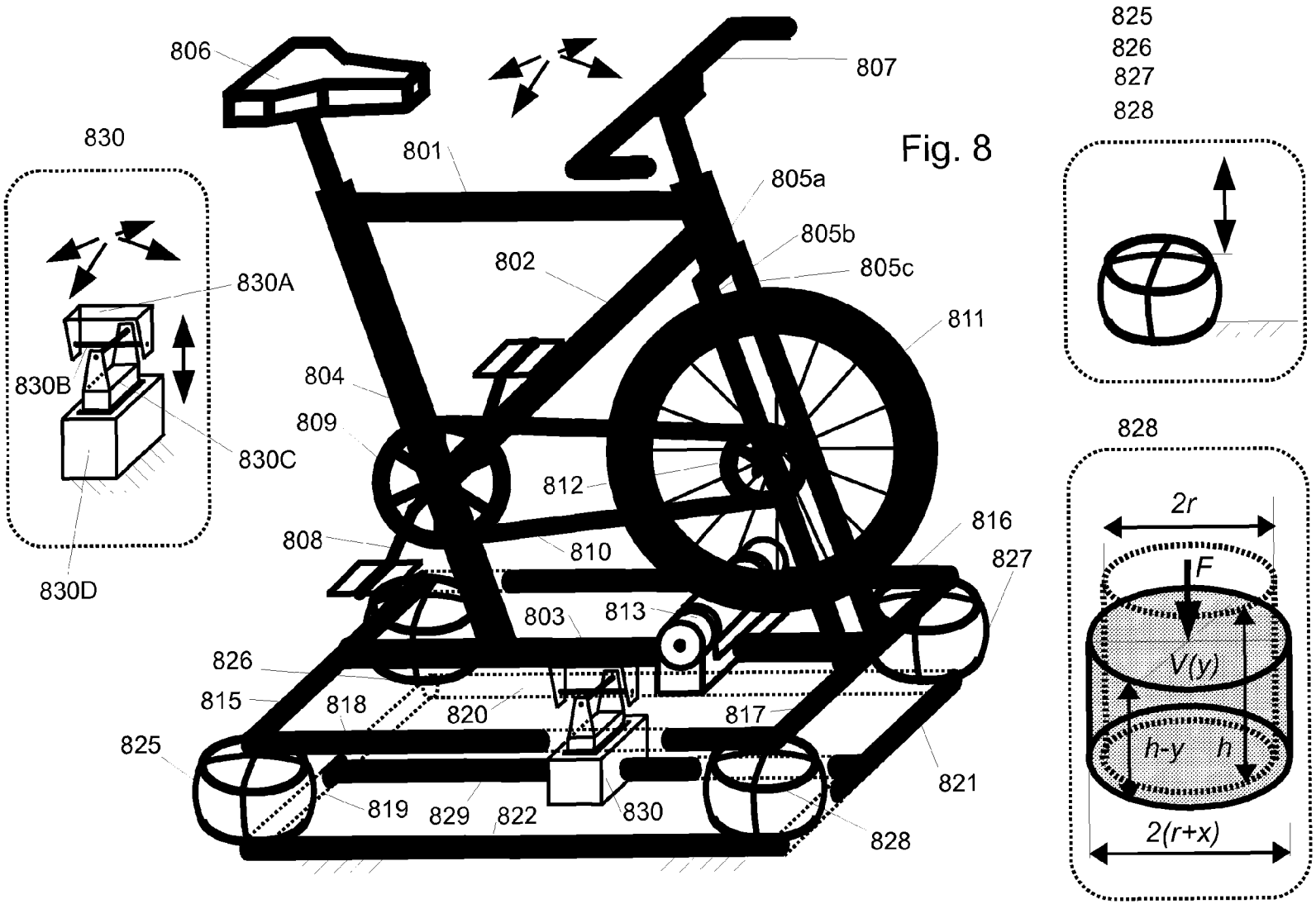
FIG. 8 is a diagram of a side to side sway capable base built with 4 elastic air-filled chambers and this base has a conventional light weight stationary bicycle frame mounted on top of it.

With reference to FIG. 8, the system of FIG. 4 is built using elastic air-filled chambers 825, 826, 827 and 828 which replace the struts 425 to 428. In a similar way, the struts 325 to 328 of FIG. 3 could be replaces by elastic air-filled chambers. The main reasons for replacing struts with elastic air-filled chambers are cost reduction and simplified construction. The elastic air-filled chambers attach directly with screws to the base core and the base support, so that no expensive ball-and-socket joints are needed as in the case of struts. On the downside, elastic air-filled chambers are less reliable than struts and also they cannot support as much weight as the struts can, which means that air-filled chambers can be used only for light bicycle frames and more important only for light riders.

The detail on the right of FIG. 8 shows a simplified diagram of the elastic air-filled chamber 828 in order to deduce its force response F to the displacement y.

$$V0 = h*\pi*r^2 \quad \text{(Eq. 21)}$$

$$V = V(y) = (h-y)*\pi*(r+x)^2 \quad \text{(Eq. 22)}$$

$$p*V = p0*V0 \quad \text{(Eq. 23)}$$

$$F = F(y) = p*\pi*(r+x)^2 \quad \text{(Eq. 24)}$$

Let us replace V from Eq. 22 into Eq. 23:

$$p*(h-y)*\pi*(r+x)^2 = (h-y)*[p*\pi*(r+x)^2]p0*V0 \quad \text{(Eq. 25)}$$

We can use Eq. 24 to replace F into Eq. 25:

$$(h-y)*F = p0*V0 = (h-0)*F(0) = h*F0 \quad \text{(Eq. 26)}$$

We obtain finally:

$$\Delta F = F - F0 = F0*\frac{h}{h-y} - F0 = F0*y/(h-y) \quad \text{(Eq. 27)}$$

Equation 27 is the same as equation 9 because ΔF is identical to $R_1$:

$$R_1(y) = F0*y/(h-y) \quad \text{(Eq. 9)}$$

This allows us to conclude that the rest of the analysis on FIG. 6 applies also for the system FIG. 8, which displays the same behavior as the gravitational well with a raised bottom center.

Figure 2:
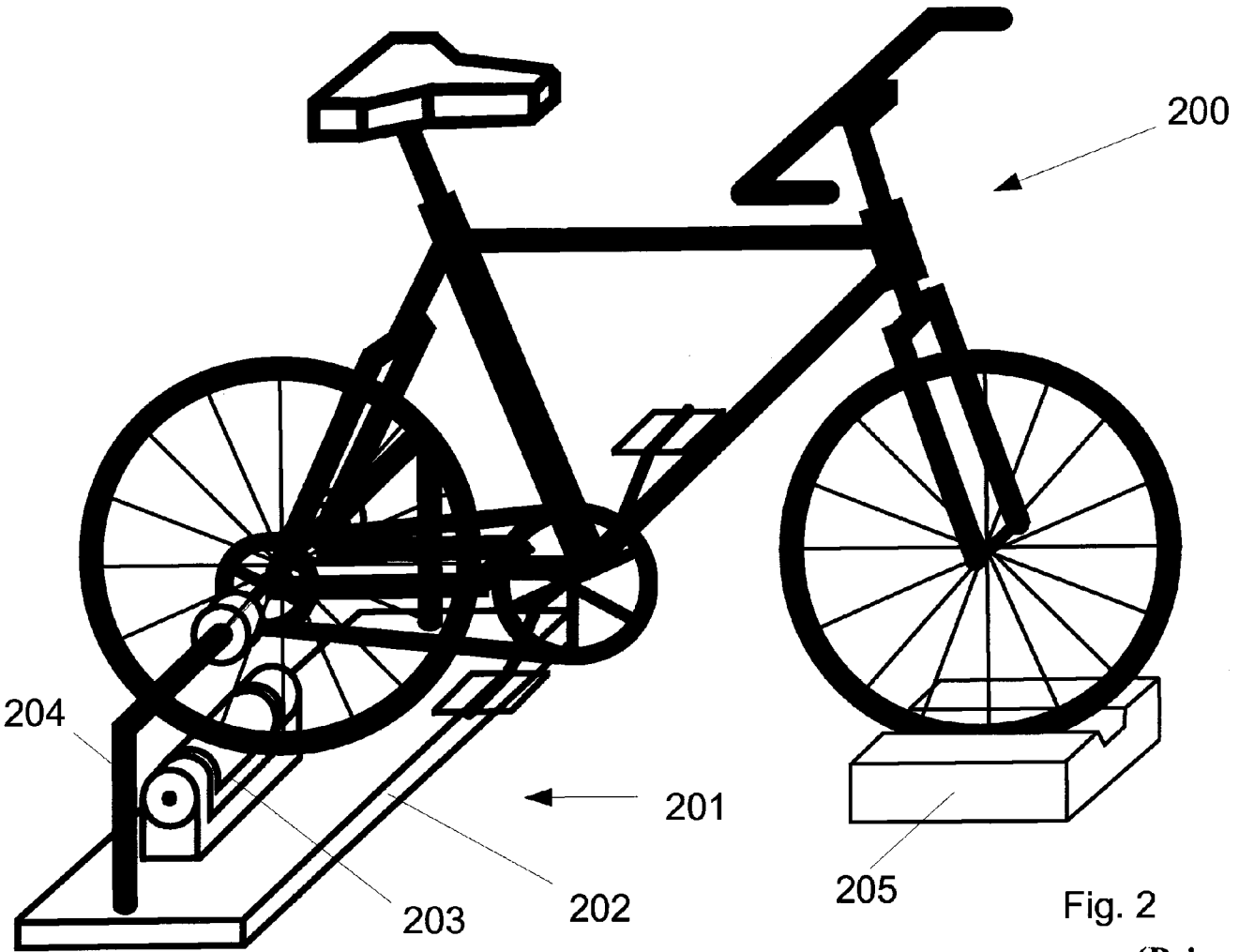
Fig. 2 (Prior Art)
FIG. 2 is a diagram of a prior art road bicycle mounted on a trainer system to convert it into a stationary bicycle.
Figure 9:
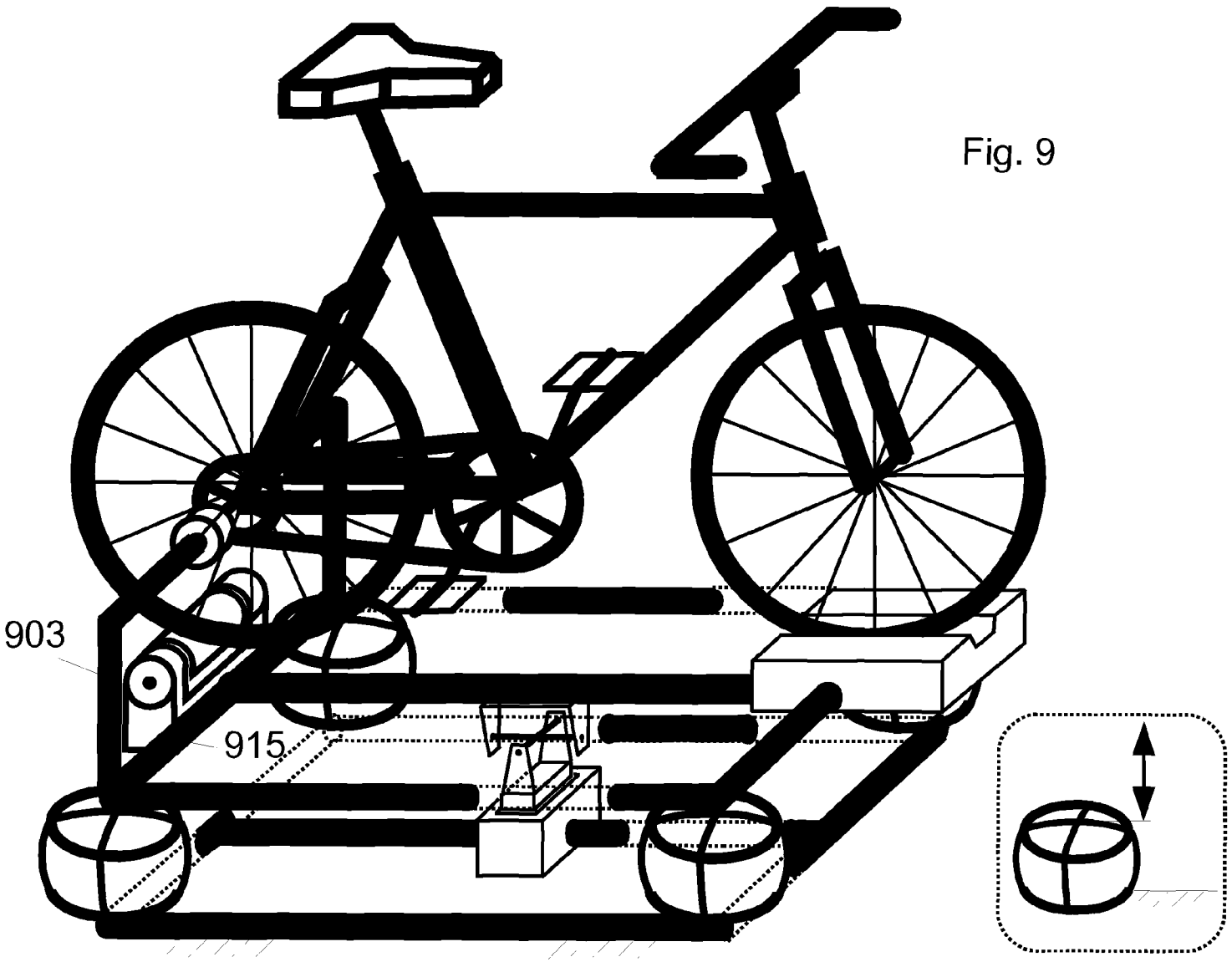
FIG. 9 is a diagram of a side to side and front to back sway capable base built with 4 elastic air-filled chambers and this base has a real road bicycle mounted on top of it by means of a trainer assembly similar to trainer 201.

FIG. 9 is a diagram of a side to side and front to back sway capable base built with 4 elastic air-filled chambers and this base has a real road bicycle mounted on top of it by means of a trainer assembly similar to trainer 201 in FIG. 2, with the exception that the trainer fork 903 is attached directly to the base core back side bar 915.

What is claimed is:

1. A sway-capable stationary bicycle comprising:

a substantially planar upper support structure having a length, a width and four corners defining a rectangle, presenting a front edge and a back edge each of the width of the structure;

a bicycle frame symmetrical about a substantially vertical frame plane, the frame including a lower substantially horizontal frame member rigidly joined to the upper support structure with the lower horizontal frame member in the plane of the upper support structure and bisecting the plane of the upper support structure along its length;

a substantially planar lower support structure of the same length and width of the upper support structure, also presenting a front edge and a back edge, the lower support structure positioned with each corner directly below each corresponding corner of the upper support structure;

four resilient members of a common relaxed height, one member at each corner joined to the upper and lower support structure, spacing the upper and lower support structures apart by an equilibrium height determined by the combined weight of the upper structures and a rider if mounted;

a first vertically-oriented stabilizing member constrained to translate only vertically, presenting a hinge at an upper end with a horizontal hinge axis, the hinge rigidly joined to the underside of the front edge of the upper support structure at substantially the center of the width, in a manner to direct the hinge axis in the length direction of the support structure, below the support structure; and a second vertically-oriented stabilizing member constrained to translate only vertically, presenting a hinge at an upper end with a horizontal hinge axis, the hinge rigidly joined to the underside of the rear edge of the upper support structure at substantially the center of the width, in a manner to direct the hinge axis in the length direction of the support structure;

wherein the hinge axes form a lengthwise axis about which the frame plane of the bicycle frame may rotate within the constraints of the comer resilient members, and the two stabilizing members keep the upper and the lower support structures substantially aligned vertically.

2. The stationary bicycle of claim 1 wherein the corner resilient members are one of pneumatic or hydraulic cylinders joined in a universally pivotable manner to each of the upper and lower frame structures, enabled to present a relaxed length and to produce a resistant force when forced by movement to contract in length.

3. The stationary bicycle of claim 1 wherein the stabilizing members are constrained to translate only vertically each by a guide rigidly joined to the front or rear edges of the lower support structure at substantially the center of the width.

4. The stationary bicycle of claim 1 wherein the corner resilient members are elastic, air-filled chambers.

5. A sway-capable stationary bicycle comprising:

a substantially planar upper support structure having a length, a width and four corners defining a rectangle, presenting a front edge and a back edge each of the width of the structure;

a bicycle frame symmetrical about a substantially vertical frame plane, the frame including a lower substantially horizontal frame member rigidly joined to the upper support structure with the lower horizontal frame member in the plane of the upper support structure and bisecting the plane of the upper support structure along its length;

a substantially planar lower support structure of the same length and width of the upper support structure, also presenting a front edge and a back edge, the lower support structure positioned with each comer directly below each corresponding comer of the upper support structure;

four resilient members of a common relaxed height, one member at each comer joined to the upper and lower support structure, spacing the upper and lower support structures apart by an equilibrium height determined by the combined weight of the upper structures and a rider if mounted;

a vertically-oriented stabilizing member constrained to translate only vertically and to prevent rotation in the horizontal plane, the member presenting a cardanic cross hinge at an upper end with one horizontal hinge axis in the direction of the length and the other in the direction of the width of the support structures, the cardanic hinge joined to the underside of the upper support structure at a point substantially at the center of the rectangle defined by the comers, and to the upper side of the lower support structure also at substantially the center of the rectangle defined by the comers;

wherein the hinge axes constrain the upper support structure to rotate in any direction about the cardanic hinge axes within the constraints of the comer resilient members, and the stabilizing member keeps the upper and the lower support structures substantially aligned vertically.

6. The stationary bicycle of claim 5 wherein the corner resilient members are one of pneumatic or hydraulic cylinders joined in a universally pivotable manner to each of the upper and lower frame structures, enabled to present a relaxed length and to produce a resistant force when forced by movement to contract in length.

7. The stationary bicycle of claim 5 wherein the corner resilient members are elastic, air-filled chambers.

* * * * *